US005335387A

United States Patent [19]

Grillat

[11] Patent Number: 5,335,387

[45] Date of Patent: Aug. 9, 1994

[54] DEVICE FOR DRYING A ROLLED METAL STRIP

[75] Inventor: Alain Grillat, Lambersart, France

[73] Assignee: Dujardin-Montbard-Somenor Z. I. Lille Seclin, Seclin Cedex, France

[21] Appl. No.: 49,122

[22] Filed: Apr. 19, 1993

[30] Foreign Application Priority Data

Apr. 29, 1992 [FR] France ..... 92 05316

[51] Int. Cl.[5] ..... B30B 3/04

[52] U.S. Cl. ..... 15/102; 72/241.6; 100/47; 100/160; 100/162 B

[58] Field of Search ..... 15/102; 72/241.6, 243.2, 72/243.4; 100/47, 160, 162 B

[56] References Cited

U.S. PATENT DOCUMENTS 4,551,878 11/1985 Turley et al. ..... 15/102
4,603,569 8/1986 Sendzimir ..... 72/241.6
4,644,860 2/1987 Brendel ..... 72/241.6
4,742,706 5/1988 Sasaki et al. ..... 72/241.6
4,945,374 7/1990 Yamamoto et al. ..... 100/168
5,136,935 8/1992 Didelot ..... 100/170

*Primary Examiner*—Edward L. Roberts
*Attorney, Agent, or Firm*—Collard & Roe

[57] ABSTRACT

A device for wiping moisture off opposite sides of a rolled metal strip comprises at least two wiping rolls disposed at the opposite metal strip sides transversely to the direction of conveyance of the metal and pressed thereagainst by rollers grouped in pairs and regularly distributed along the rolls for support thereof. To obtain a uniform pressure of the rolls against the opposite metal strip sides across its entire width, jacks press the supporting rollers against the rolls and the pressure is controlled as a function of the width of the rolled metal strip and the position thereof so that the pressure applied by the rolls on the opposite sides of the rolled metal strip is limited to the portion of the rolls in contact with the rolled metal strip.

5 Claims, 3 Drawing Sheets

DEVICE FOR DRYING A ROLLED METAL STRIP

BACKGROUND OF THE INVENTION

1. Field of the Invention

The present invention relates to the cold rolling of metal strips. In cold rolling mills, it is necessary to project substantial amounts of a liquid constituted by oil or an emulsion of oil in water against the opposite sides of the metal strip before it enters the rolling mill to assure the lubrication and cooling of the metal strip and the rolls of the mill. After the rolled metal strip leaves the rolling mill, it is necessary to remove the liquid films covering the opposite sides of the rolled metal strip so that they do not interfere with the operations to which the metal strip is subsequently subjected, particularly to permit the rolled metal strip to be properly reeled.

2. Description of the Prior Art

U.S. Pat. No. 4,551,878 discloses a device for wiping liquids from the surfaces of a rolled metal strip by moving the metal strip under tension through a device consisting of three rolls between which the strip passes. The rolls are disposed at the opposite sides of the strip transversely to the direction of conveyance thereof and they are applied against the opposite sides under a predetermined pressure. Usually, rolls of a small diameter are used because they are more efficient, and to avoid their bending under pressure, the pressure to which the rolls are subjected is applied by springs and pairs of casters distributed regularly along the length of the rolls. This structure permits a regular pressure to be applied over the entire width of the metal strip as long as this width differs little from the length of the rolls. On the other hand, if the length of the rolls substantially exceeds the width of the strip, the rolls are deformed by flexing, which produces a poor drying of the center portion of the metal strip.

SUMMARY OF THE INVENTION

It is the primary object of this invention to provide a better control of the drying over the entire width of the rolled metal strip. It is another object of the invention to provide a device for drying metal strips, which permits ready maintenance and replacement of the drying rolls and their support structure.

The above and other objects are accomplished according to one aspect of the present invention with a process of wiping moisture off the opposite sides of a rolled metal strip, comprising the steps of feeding the rolled metal strip in a direction of conveyance between at least two rolls disposed at the opposite sides of the metal strip transversely to the direction of conveyance and supported by rollers distributed regularly along the length of the rolls, pinching the rolled metal strip between the oppositely disposed rolls by applying pressure to the rollers supporting the rolls by fluid-operated jacks, and controlling the fluid pressure applied to the rollers by the jacks as a function of the width of the rolled metal strip and the position thereof so that the pressure applied by the rolls on the opposite sides of the rolled metal strip is limited to the portion of the rolls in contact with the rolled metal strip. The fluid pressure in the jacks is preferably controlled as a function of the feeding speed of the rolled metal strip.

According to another aspect of this invention, there is provided a device for wiping moisture off the opposite sides of a rolled metal strip, comprising at least two rolls disposed at the opposite sides of the metal strip transversely to a direction of conveyance of the rolled metal strip between the oppositely disposed rolls, rollers distributed regularly along the length of the rolls and arranged to support the rolls and to apply the rolls against the opposite sides of the metal strip, fluid-operated jacks acting upon the rollers to pinch the rolled metal strip between the oppositely disposed rolls, means for controlling the fluid pressure in the jacks to control the pressure applied to the rollers supporting the rolls by fluid-operated jacks, a support frame including a respective cross beam on each one of the opposite sides of the rolled metal strip, each cross beam defining a housing extending along the cross beam and having opposite ends, and the fluid-operated jacks being mounted on the cross beams, and a support bar disposed in each housing and carrying a respective one of the rolls and the rollers supporting the respective rolls, each one of the support bars and the roll and rollers carried thereby constituting an assembly removable from the housing thereof at one of the ends thereof.

In the illustrated embodiment, each support bar has a horizontal face facing the respective roll, the rollers supporting each roll are arranged in pairs, and the device further comprises a respective bearing block whereon each pair of rollers is mounted, a rod affixed to each bearing block and passing through the support bar, the rod having a head remote from the horizontal support bar face, and spring means compressed between the support bar and the head of the rod for pressing the bearing blocks against the horizontal support bar face in the absence of pressure applied by the jacks.

The fluid-operated jacks preferably have piston rods, the jacks being so mounted on the cross beams that the piston rods of the jacks extend through bores in the cross beams and are aligned with the rods affixed to the bearing blocks to press against the rods affixed to the bearing blocks upon applying fluid pressure to the piston rods, the piston rods being retractible in the bores to permit the support bars to be disassembled.

BRIEF DESCRIPTION OF THE DRAWING

The above and other objects, features and advantages of this invention will become more apparent from the following detailed description of a now preferred embodiment thereof, taken in conjunction with the accompanying drawing wherein.

DETAILED DESCRIPTION OF THE PREFERRED EMBODIMENT

Figure 1:
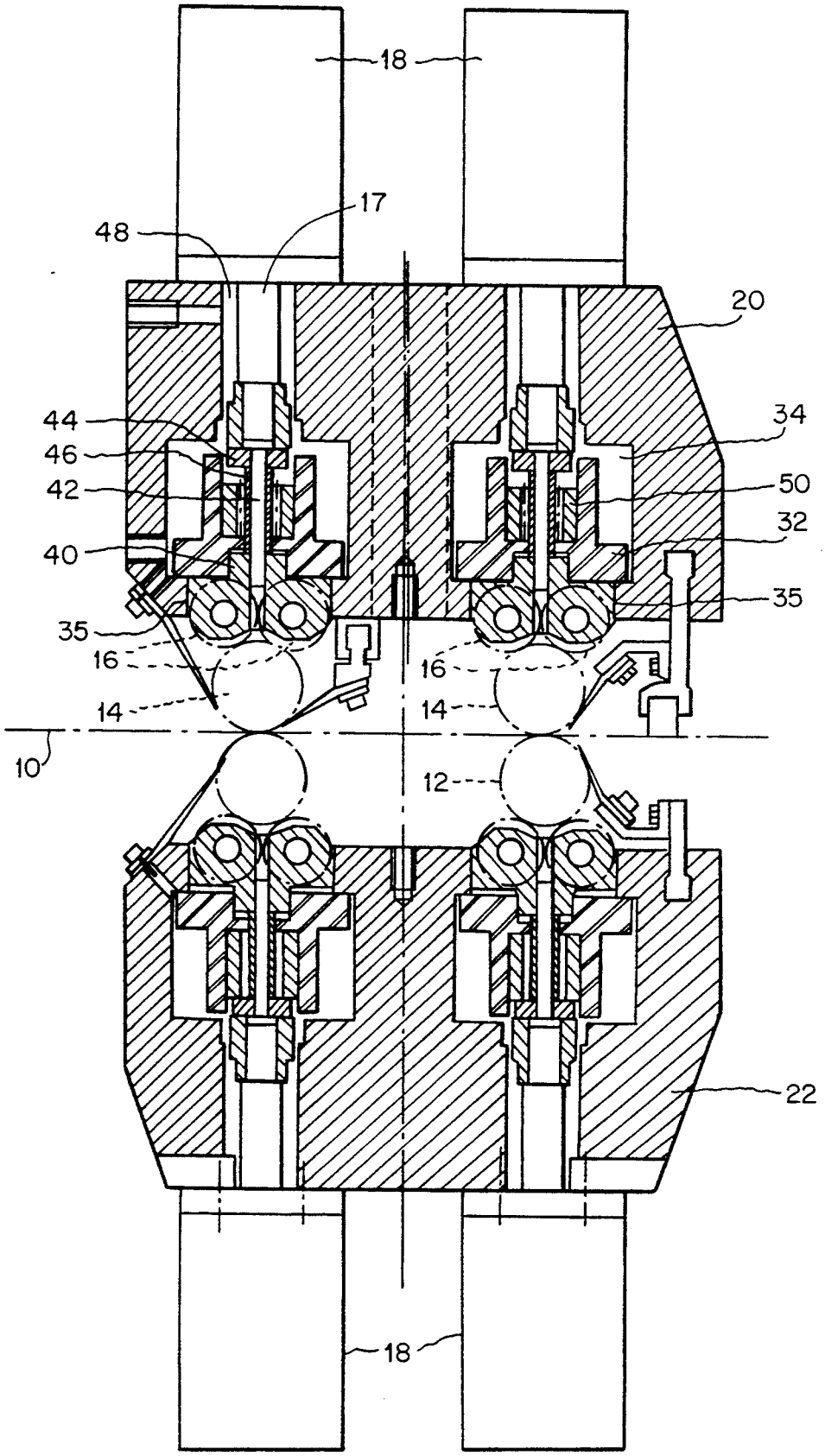
FIG. 1 shows a device for wiping off moisture from the opposite sides of a rolled metal strip, taken in cross section along a plane extending perpendicularly to the axes of the wiping rolls.
Figure 2:
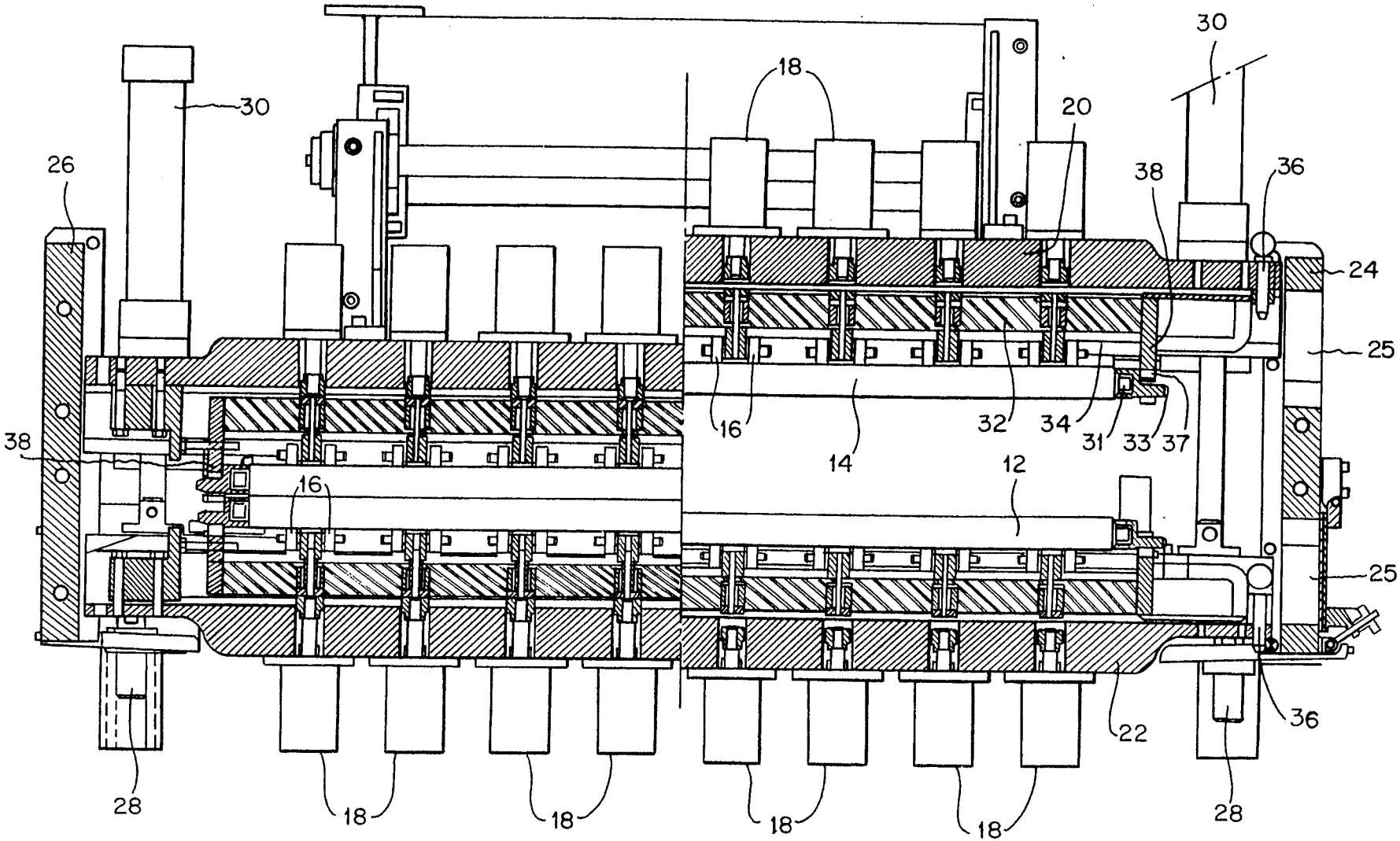
FIG. 2 shows the device of FIG. 1 at a smaller scale, taken in cross section along a plane of symmetry extending parallel to the axes of the wiping rolls, the left side of the figure showing the rolls in their operating position wherein the rolled metal strip is pinched between the rolls and the right side of the figure showing the rolls spaced apart.

Referring now to the drawing and first to FIGS. 1 and 2, there is shown a device for wiping moisture off the opposite sides of rolled metal strip 10 fed to the device from a cold rolling mill (not shown). The illustrated drying device comprises two pairs of rolls 12, 14, lower wiping rolls 12 being disposed at one side of metal strip 10 and upper rolls 14 being disposed at the opposite side of the metal strip transversely to a direction of conveyance of the rolled metal strip between the oppositely disposed rolls 12, 14. Pairs of rollers 16 are distributed regularly along the length of the rolls 12, 14 and are arranged to support the rolls and to apply the rolls against the opposite sides of metal strip 10, as shown in FIG. 2. Fluid-operated jacks 18 act upon rollers 16 to pinch the rolled metal strip between the oppositely disposed rolls 12, 14, as shown in FIG. 1 and the left side of FIG. 2. Means for controlling the fluid pressure in jacks 18 to control the pressure applied to rollers 16 supporting rolls 12, 14 by fluid-operated jacks 18 will be described hereinbelow in connection with FIG. 3.

A support frame for the device includes a respective cross beam 20 and 22 of large cross section extending on each one of the opposite sides of rolled metal strip 10. Each cross beam 20, 22 defines housing 34 extending along the cross beam and having opposite ends glidably mounted in vertical slides 24 and 26. The slides are affixed to the support of the cold rolling mill (not shown). Lower cross beam 22 rests on elastically yielding stops or abutments 28, 28 which are, affixed to slides 24, 26. These stops or abutments are so arranged at the ends of lower rolls 12 that the lower rolls are slightly spaced from the lower side of metal strip 10 when pneumatic jacks 18 are not under pressure. Hydraulic jacks 30 interconnect lower cross beam 22 to upper cross beam 20 to enable the lower and upper rolls to be adjusted between an operating position of the wiping rolls (shown at the left of FIG. 2) and a rest position (shown at the right of FIG. 2), the relative positions of the cross beams being delimited by abutments spacing the cross beams so that they assume the respective positions shown in FIG. 2. Fluid-operated jacks 18 are mounted on cross beams 20, 22.

A support bar 32 is disposed in each housing 34 and carries a respective roll 12, 14 and rollers 16 supporting the respective rolls, each one of support bars 32 and the roll and rollers carried thereby constituting an assembly removable from the housing 34 thereof at one of the ends thereof. Each longitudinally extending housing 34 is of rectangular cross section and has slit 35 leading to a horizontal face of respective cross beams 20, 22. The assembly comprised of support bar 32 and the rollers and rolls associated therewith may be withdrawn from its housing 34 in the cross beam at one of its ends through an aligned opening 25 in slide 24 after pin 36 has been removed.

Each wiping roll 12, 14 is supported at its opposite ends to the opposite ends of support bar 32 by brackets 38. This assembly is effectuated by means of bearings 34 whose tail 33 glides in vertical slot 37 in bracket 38 so that rolls 12, 14 may be displaced vertically relative to cross beams 20, 22. Access to vertical slots 37 may be closed by a movable element, such as a cotter pin, which enables the rolls to be disassembled from the cross beams.

Each support bar 32 has a horizontal face facing the respective roll 12, 14, and rollers 16 supporting each roll are arranged in groups of two pairs of rollers disposed symmetrically with respect to a vertical plane passing through the axis of the associated roll. The four rollers of the two pairs forming each group of rollers 16 are mounted on bearing block 40. Each bearing block is fixed to support bar 32 by an elastic connection constituted by threaded rod 42 affixed to each bearing block and passing through support bar 32, a head comprised of nut 44 remote from the horizontal support bar face, and spring 46 compressed between support bar 32 and head 44 of rod 42 for resiliently holding bearing blocks 40 flush with the horizontal support bar face in the absence of pressure applied by pneumatic jacks 18. Bearing blocks 40 engage slots 35 with a slight friction. When no compressed air is fed to jacks 18, bearing blocks 40 are pressed against the horizontal support bar face by spring 46.

Fluid-operated jacks 18 have piston rods 17, the jacks being so mounted on cross beams 20, 22 that the piston rods of the jacks extend coaxially through bores 48 in the cross beams and are aligned with rods 42 affixed to bearing blocks 40 to press against the rods 42 affixed to the bearing blocks upon applying fluid pressure to piston rods 17. The piston rods are retractible in bores 48 out of contact with rods 42, as shown on the right side of FIG. 2, to enable support bars 32 to be removed from their housings 34. When fluid, i.e. compressed air, is supplied to jacks 18 under pressure, piston rods 17 press against nuts 44 of rods 42 and the resultant pressure is transmitted to rollers 16 and rolls 12, 14 by rods 42 and bearing blocks 40.

The vertical movement of rollers 16 is delimited by stop rings 50 mounted on support bar 32. For lower wiping rolls 12, this vertical movement is so adjusted by stop rings 50 that the lower rolls are positioned at the level of the lower side of metal strip 10, as shown in FIG. 1 and the left side of FIG. 2, when nuts 44 on the ends of rods 42 contact stop rings 50.

Figure 3:
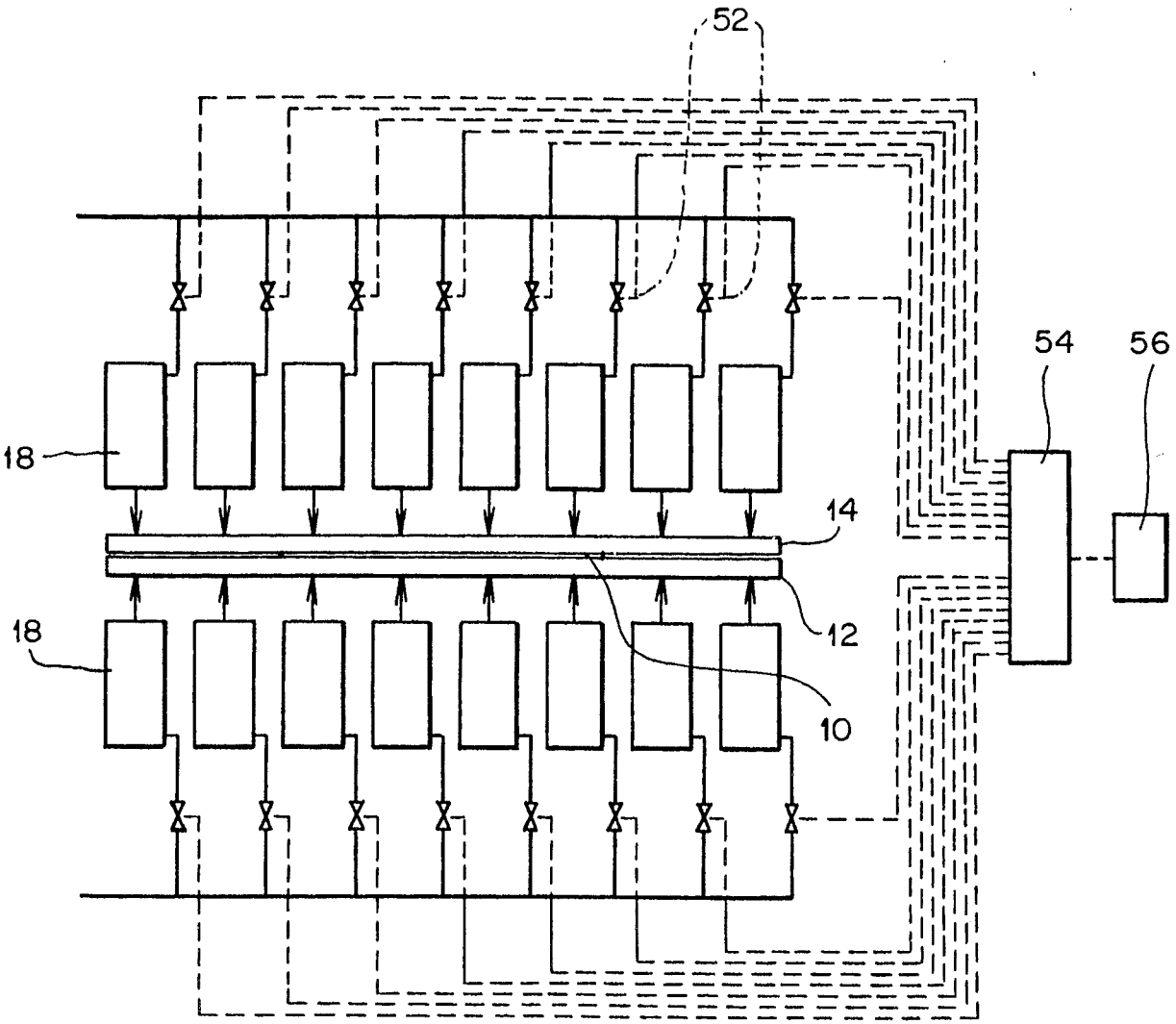
FIG. 3 is an operating diagram showing the control of the device.

FIG. 3 illustrates the process of the invention. Rolled metal strip 10 is fed in a direction of conveyance between rolls 12, 14 disposed at the opposite sides of the metal strip transversely to the direction of conveyance and pinches the oppositely disposed rolls by applying pressure to rollers 16 supporting rolls 12, 14 by fluid-operated jacks 18. The fluid, i.e. compressed air, pressure applied to the rollers by jacks 18 is controlled as a function of the width of rolled metal strip 10 and the position thereof so that the pressure applied by rolls 12, 14 on the opposite sides of rolled metal strip 10 is limited to the portion of the rolls in contact with the rolled metal strip, which in the embodiment of FIG. 3 is the center portion of rolls 12, 14. The fluid pressure in the jacks may further be controlled as a function of the feeding speed of the rolled metal strip.

As shown, this fluid pressure control supplying compressed air to jacks 18 comprises a respective solenoid valve 52 controlling the compressed air flow to each jack. Each solenoid valve is connected to interface 54 which is a hardware element transforming the digital signals coming from control computer 56 into analog signals applied to the valves and the analog signals coming from pressure gages on the jacks into digital signals which can be processed by the control computer. The control computer also controls the operation of the rolling mill. It receives signals from signal inputs placed on the rolling mill, processes control signals on the basis of instructions in its memory and/or information input by an operator, and transmits these control signals to the rolling mill to modify designated parameters of its operation.

At the beginning of the rolling operation, control computer 56 stores in its memory the relative parameters of metal strip 58, particularly its width. After cross beams 20, 22 have been brought to their operating position by actuating hydraulic jacks 30, the control computer controls the flow of compressed air to selected jacks 18 by suitably adjusting respective ones of solenoid valves 52 so that the flow of compressed air is limited to those eight jacks 18 at the center of rolls 12, 14 in FIG. 3, which are in contact with metal strip 10. The jacks at the two sides of metal strip 10 at the margins of the wiping rolls are not supplied with compressed air or are supplied therewith at a reduced pressure. Control computer 56 may, of course, be programmed so that it controls the pressure supply to jacks 18 as a function of any desired parameter of the rolling operation, including the speed of conveyance of the metal strip.

What is claimed is:

1. A device for wiping moisture off the opposite sides of a rolled metal strip, comprising (a) at least two rolls disposed at the opposite sides of the metal strip transversely to a direction of conveyance of the rolled metal strip between the oppositely disposed rolls, (b) rollers distributed regularly along the length of the rolls and arranged to support the rolls and to apply the rolls against the opposite sides of the metal strip, (c) fluid-operated jacks acting upon the rollers to pinch the rolled metal strip between the oppositely disposed rolls, (d) means for controlling the fluid pressure in the jacks to control the pressure applied to the rollers supporting the rolls by fluid-operated jacks, (e) a support frame including a respective cross beam on each one of the opposite sides of the rolled metal strip, each cross beam defining (1) a housing extending along the cross beam and having opposite ends, and (2) the fluid-operated jacks being mounted on the cross beams, and (f) a support bar disposed in each housing and carrying a respective one of the rolls and the rollers supporting the respective rolls, (1) each one of the support bars and the roll and rollers carried thereby constituting an assembly removable from the housing thereof at one of the ends thereof.

2. The device of claim 1, wherein each support bar has a horizontal face facing the respective roll, the rollers supporting each roll are arranged in pairs, further comprising a respective bearing block whereon each pair of rollers is mounted, a rod affixed to each bearing block and passing through the support bar, the rod having a head remote from the horizontal support bar face, and spring means compressed between the support bar and the head of the rod for pressing the bearing blocks against the horizontal support bar face in the absence of pressure applied by the jacks.

3. The device of claim 2, wherein the fluid-operated jacks have piston rods, the jacks being so mounted on the cross beams that the piston rods of the jacks extend through bores in the cross beams and are aligned with the rod affixed to the bearing blocks to press against the rods affixed to the bearing blocks upon applying fluid pressure to the piston rods, the piston rods being retractible in the bores.

4. The device of claim 1, wherein the controlling means is adapted to control the fluid pressure in the jacks as a function of the width of the rolled metal strip and the position thereof.

5. The device of claim 1, wherein the controlling means is adapted to control the fluid pressure in the jacks as a function of the feeding speed of the rolled metal strip.

* * * * *